US006523835B1

(12) United States Patent
Lyden

(10) Patent No.: US 6,523,835 B1
(45) Date of Patent: Feb. 25, 2003

(54) BLADE FOR AN ICE SKATE

(76) Inventor: Robert M. Lyden, 18261 SW. Fallatin Loop, Aloha, OR (US) 97007

( * ) Notice: Subject to any disclaimer, the term of this patent is extended or adjusted under 35 U.S.C. 154(b) by 0 days.

(21) Appl. No.: 09/660,694

(22) Filed: Sep. 13, 2000

Related U.S. Application Data

(63) Continuation-in-part of application No. 09/239,422, filed on Jan. 28, 1999, now abandoned.

(51) Int. Cl.[7] ..... A63C 1/00; A63C 1/30

(52) U.S. Cl. ..... 280/11.12; 280/28; 280/28.15; 280/11.18

(58) Field of Search ..... 280/28.15, 11.17, 280/811, 11.14, 11.18, 11.12, 28, 11.15, 11.16

(56) References Cited

U.S. PATENT DOCUMENTS

| | | | | |
|---|---|---|---|---|
| 25,295 | A | 8/1859 | Wheeler | |
| 38,173 | A | 4/1863 | Marvin | |
| 216,159 | A | 6/1879 | Dowler | 280/11.18 |
| 2,118,892 | A | 5/1938 | Mays | 280/11.3 |
| 2,244,719 | A | 6/1941 | Mansfield | 280/11.3 |
| 2,998,260 | A | 8/1961 | Meyer | 280/7.13 |
| 3,026,118 | A | 3/1962 | Pare | 280/11.3 |
| 3,292,940 | A | 12/1966 | Weitzner | 280/7.13 |
| 3,526,976 | A | 9/1970 | Jacobs | 36/2.3 |
| 3,689,091 | A | 9/1972 | Nagin | 280/11.12 |
| 3,918,728 | A | 11/1975 | Stugger et al. | 280/11.138 |
| 3,918,729 | A | 11/1975 | Peters | 280/11.3 |
| 4,085,944 | A | 4/1978 | Chambers | 280/11.12 |
| 4,114,295 | A | 9/1978 | Schaefer | 36/100 |
| 4,314,708 | A | 2/1982 | Zuuring | 280/11.18 |
| 4,826,183 | A | 5/1989 | Bratland et al. | 280/7.13 |
| 4,907,813 | A | 3/1990 | Hall | 280/11.18 |
| 4,988,122 | A | 1/1991 | Sauders | 280/841 |
| 5,195,781 | A | 3/1993 | Osawa | 280/842 |
| 5,255,929 | A | 10/1993 | Lemelson | 280/11.18 |
| 5,318,310 | A | 6/1994 | Laberge | 280/11.17 |
| 5,320,368 | A | 6/1994 | Lang | 280/11.12 |
| 5,383,674 | A | 1/1995 | Cann et al. | 280/11.18 |
| 5,393,077 | A | 2/1995 | Wanous | 280/7.13 |
| 5,484,148 | A | 1/1996 | Olivieri et al. | 280/11.18 |
| 5,516,556 | A | 5/1996 | Baker et al. | 427/355 |
| 5,641,169 | A | 6/1997 | Bekessy | 280/11.18 |
| 5,769,434 | A | 6/1998 | Wurthner | 280/11.18 |
| 5,826,890 | A | 10/1998 | Swande | 280/11.18 |
| 5,832,636 | A | 11/1998 | Lyden | 36/59 R |
| 5,839,734 | A | 11/1998 | Steinhauser, Jr. | 280/7.13 |
| RE35,993 | E | 12/1998 | Gierveld | 280/11.22 |
| 5,845,927 | A | 12/1998 | Steinhauser, Jr. | 280/7.14 |

FOREIGN PATENT DOCUMENTS

| | | | |
|---|---|---|---|
| CA | 682629 | 3/1964 | 280/11.18 |
| DE | ST5912X1/77 B | 2/1955 | 280/11.18 |
| EP | 0311196 | 4/1989 | 280/11.18 |
| EP | 1013313 A1 | 6/2000 | A63C/1/00 |
| NL | 8702068 | 4/1989 | 280/11.14 |

OTHER PUBLICATIONS

J.A. Henckels "Twinstar" ® Ads Lanxide Coated Products Internet Homepage Inform.

QQC. Inc. Information www.PhotonicsNet.com Composite Particles, Inc. Inform. Re: VISTAMER ®.

Zandstra Big Bend Ad.

*Primary Examiner*—Lesley D. Morris
*Assistant Examiner*—Matthew Luby
(74) *Attorney, Agent, or Firm*—Westman, Champlin & Kelly, P.A.

(57) ABSTRACT

The present invention teaches a runner or blade for an ice skate having a novel configuration and structure, such as a blade having greater width at the edge at both the anterior end and posterior end relative to the middle, or alternately, a blade having greater width at the edge at the anterior end relative to the middle and posterior end. Further, a runner or blade for an ice skate can include a thermoplastic material, fiber fillers, metal fillers, and a hydrophobic material. In addition, the present invention teaches a hinged blade for a hockey skate.

35 Claims, 6 Drawing Sheets

BLADE FOR AN ICE SKATE

CROSS-REFERENCE TO RELATED APPLICATION

The present application is a Continuation-In-Part of Ser. No. 09/239,422, filed Jan. 28, 1999 now abandoned, entitled "Novel Blade For An Ice Skate."

FIELD OF THE INVENTION

The present invention teaches a runner or blade for an ice skate having greater width at the edge at the anterior end relative to the middle. Further, the present invention teaches a blade having greater width at the edge at both the anterior end and posterior end relative to the middle. In addition, the present invention teaches a runner or blade for an ice skate including thermoplastic, metal, and fiber materials. Moreover, the present invention teaches a novel hinged blade for a skate.

BACKGROUND OF THE INVENTION

Runners or blades for ice skates have been traditionally made of metal such as steel. In recent years, the preferred metal for use in ice skate blades has been stainless steel, such as that supplied by the Sandvig company. Traditional steel blades are generally stronger and hold an edge better than stainless steel, but the latter has the advantage of being lighter and resistant to rust and corrosion. Conventional metal skate blades for use in hockey are often removable and generally have a configuration including substantially parallel sides, rocker, and an edge. It is possible that greater design freedom, reduced weight, lower costs, and improved performance can be attained by using thermoplastic, composite, and ceramic materials in a skate blade. In this application, the working surface of a blade is hereby defined as that portion which is intended for contact with the ice surface for the purpose of performing useful work.

There have been numerous attempts to improve blades for ice skates by the addition of various treatments and coatings. U.S. Pat. No. 5,255,929 granted to Jerome Lemelson teaches a diamond coating for use on a skate blade. Diamond coatings are also used on knives, such as J.A. Henckels Twinstar MagnaDur® knives. Diamond coatings can be quite smooth and are known to be the hardest in existence. U.S. Pat. No. 3,918,728 granted to Walter Stugger and Arnold Sprung teaches a snow ski including a metal edge having a thin layer of hard tungsten carbide particles fused thereto. U.S. Pat. No. 4,131,288 granted to Stephen Wilson teaches a skate blade including a strip of tungsten carbide which is induction brazed to carbon steel. U.S. Pat. No. 5,516,556 granted to Larry Baker and Harry White teaches a polytetrafluoroethylene (PTFE) composition for burnishing an ice skate blade.

U.S. Pat. No. 4,314,708 granted to Peter Zuuring teaches the inclusion of a relatively soft thermoplastic material having a wettability index of equal to or greater than 90 degrees such as polytetrafluoroethylene (PTFE) or TEFLON®, or a harder ultra high molecular weight polyethylene material (UHMW PE) having similar wettability characteristics in conjunction with a metal ice skate blade. Definition and discussion of the term "wettability index" and numerous hydrophobic materials having a wettability index equal to or greater than 90 degrees can be found in U.S. Pat. No. 5,832,636 granted to Robert Lyden and Souheng Wu, this patent hereby being incorporated by reference herein. Materials having a wettability index equal to or greater than 90 degrees are hydrophobic, that is, they are characterized by having a low surface energy and tend to repel water. When a traditional ice skate blade travels across the ice, the heat which is present in the blade, and also the friction and dampening induced by movement causes ice crystals to melt underneath the blade. As result, an ice skate blade can at least partially be caused to hydroplane on water. This can lower the resistance and friction acting upon an ice skate blade, and within certain limitations, can be associated with a faster skate and less energy expenditure by a skater. The inclusion of materials having low surface energies and a wettability index equal to or greater than 90 degrees is known to further reduce the static and dynamic coefficient of friction of an ice skate blade, thus can potentially result in an even faster skate that requires even less energy expenditure by a skater.

However, polytetrafluoroethylene (PTFE), or TEFLON®, a hydrophobic material, is known to be relatively soft and subject to creep. Accordingly, it does not hold up well nor is it hard enough to use in a substantial portion of an ice skate blade. A harder hydrophobic material such as ultra high molecular weight polyethylene material (UHMW PE) can be more suitable for use, but when used alone even this material is not hard or long wearing enough to use on the edges of an ice skate blade. Accordingly, it can be advantageous to use robust thermoplastic materials and to include extremely hard metal filler materials such as titanium or tungsten carbide in an ice skate blade. Further, the use of fiber filler materials such as glass fiber, aramide fiber, carbon fiber, boron fiber, or stainless steel fiber can be advantageous. The use of metal fibers, carbon fibers, or other like fillers, can also render an ice skate blade electrically conductive. This can improve the performance of a blade by reducing the possible build-up of static electrical charge. European Patent 311,196 granted to Nierstrasz, and Dutch Patent 8,702,068 granted to Van Ooijen, teach skate blades which include ceramic and/or fiber reinforced materials.

When playing hockey, skaters will engage in frequent and sudden accelerations. In this regard, it is known that a reduction in skate blade weight, and generally, the weight of a hockey player's skates can have a significant impact on their demonstrated ability to accelerate and attain high skating speeds. It is also known that a reduction in the penetration of an ice skate blade into the ice can, within certain limitations, result in greater speed and better skating performance. Further, reduced penetration of a blade into the skating surface will result in less rapid degradation and so enhance the longevity of the skating surface.

With reference to a metal ice skate blade, there is generally an inverse relationship between the mass and contact area of the blade, and exhibited speed, that is, the greater the mass of the blade, and/or the larger the contact area of the blade, then the slower is skating performance with the blade and associated skate. However, the relationship between the mass and/or contact area of a substantially thermoplastic skate blade, and exhibited speed can be more complex. In particular, there can be an limited range of optimal contact area for a given skater having known mass who imparts a known force with a characteristic skating technique, thus either greater or lesser surface contact area can result in slower skating performance with a given blade and associated skate.

Moreover, as the forces and pressure applied to various portions of an ice skate blade are not uniform in any given characteristic skating technique, the optimal configuration of an ice skate blade is not necessarily characterized by substantially consistent and unchanging width at the edge throughout the runner or blade as is prevalent in the prior art. By way of analogy, it is now recognized in the sport of skiing that widening both the tips and tails of a ski can provide better maneuverability and handling characteristics for some skiers given certain snow conditions. The present invention teaches novel skate blades which have varying width dimensions at the edge in different portions.

U.S. Pat. No. 216,159 granted to Dowler in 1879, hereby incorporated by reference herein, discloses a skate blade having greater width at the edge near the anterior and posterior ends relative to the middle. However, as shown in the drawing figures, the blade taught by Dowler attains maximum width at the edge at a distance short of both the anterior and posterior ends, and the blade then substantially decreases in width at the edge and tapers towards the respective ends. This configuration is dysfunctional with respect to blades intended for use in modern hockey skates or speed skates. When a skater would use a blade having the configuration illustrated by Dowler with the side stroke technique commonly used in hockey and speed skating, and in particular, when getting up on their forefoot during the latter part of the propulsive phase of the skating cycle, the transition as between the widest portion of the blade at the edge at some distance from the anterior end, and the tapered portion proximate the anterior end of the blade can result in greater and more rapid inward rotation of the blade, skate, and the wearer's foot. This can cause the blade to lose its holding power and, contact with the ice surface, and is undesirable given the conduct of frequent accelerations, stops, and rapid turning maneuvers associated with hockey competition within the confines of a modern arena. Accordingly, the configuration of a skate blade illustrated by Dowler is not advantageous for use in hockey, or speed skating on an oval. This is understandable, as the sports of hockey and speed skating have evolved considerably since the Dowler patent was granted.

German Patent St 5912 X1/77b, hereby incorporated by reference herein, granted to Hans Schwarz, Koln-Riehl, and Dr. Berger discloses a blade for a figure skate including a toe pick. The toe pick constitutes a part of the working surface of a figure skate blade and is used to engage the ice both in propulsive and braking actions. In the Schwartz reference, the widest portion of the blade at the edge is at the posterior side of the toe pick, and the blade then tapers and narrows in width at the edge towards the anterior end, and also towards the middle and posterior end.

U.S. Pat. No. 4,907,813 granted to Hall teaches a blade for a hockey skate having an upper portion which can be secured in functional relation to a blade support. The blade has a toe section, a median section, and a heel section, and also a lower portion which includes an edge. The thickness of the lower portion of the blade at the edge in the toe section can vary in the range between 2.7–3.0 mm, whereas the thickness of the lower portion of the blade at the edge in both the median section and the heel section can vary in the range between 1.4–2.0 mm. On the lower portion of the blade at the edge, the interface between the narrow part of the blade and the wider toe section has a radius of 76 mm, and this makes for a relatively abrupt transition. Aside from this interface area, both the upper portion of the blade, and the lower portion of the blade have parallel sides and inside and outside edges.

The present invention teaches skate blades having novel configurations which are advantageous for use in hockey and speed skates. Blades of the present invention are believed to facilitate improved acceleration, maximum speed, cornering, and overall skating performance. Further, blades of the present invention can facilitate novel skate design, configuration and geometry relative to conventional hockey skates and speed skates.

SUMMARY OF THE INVENTION

The present invention teaches a runner or blade for an ice skate having a novel configuration and structure. A preferred blade for a hockey skate has greater width at the edge at both the anterior end and posterior end relative to the middle. Given the common side stroke skating technique used in hockey and speed skating, a skate blade configuration having greater relative width at the edge at the anterior end and posterior end relative to the middle can potentially enable faster acceleration and de-acceleration, improved turning performance, and a stronger or longer skating stroke characterized by greater edge control and application of power.

A preferred blade for a hockey skate includes an edge extending between an anterior end, a central portion including the middle, and a posterior end. The central portion has a straight edge having a constant width. The edge preferably gradually increases in width from the central portion to the anterior end, and also to the posterior end. The edge at the anterior end preferably has equal maximum width as the edge at the posterior end. Alternately, the edge at the anterior end can have greater maximum width than the edge at the posterior end. The width at the edge can gradually increase from the central portion to the anterior end, and also to the posterior end, in a non-linear manner to form a semi-curved configuration. Alternately, the width at the edge can gradually increase from the central portion to the anterior end, and also to the posterior end, in a linear manner to form a semi-curved configuration. The minimum width at the edge in the central portion including the middle is preferably equal to or greater than 2.0 mm, and the maximum width at the edge at the anterior end and the posterior end is preferably less than or equal to 4.0 mm. The central portion including the middle preferably has a length in the range between 50–140 mm. The width at the edge at the anterior end and posterior end is preferably in the range between 101–150% of the width at the edge at the middle. In particular, the width at the edge at the anterior end and posterior end is preferably in the range between 125–135% of the width at the edge at the middle.

An alternate preferred blade for an ice skate includes an edge extending between an anterior end, a central portion including the middle, and a posterior end. The width at the edge gradually increases from the central portion including the middle to the anterior end, and also to the posterior end. The edge at the anterior end has greater maximum width than the edge at the middle, and also the edge at the posterior end. The width at the edge at the anterior end is preferably in the range between 125–150% of the width at the edge at the middle, and the width at the edge at the posterior end is preferably in the range between 110–135% of the width at the edge at the middle. The width at the edge can gradually increase from the central portion including the middle to the anterior end, and to the posterior end, in a non-linear manner to form a semi-curved configuration. Alternately, the width at the edge can gradually increase from the central portion including the middle to the anterior end, and to the posterior end, in a linear manner to form a semi-curved configuration.

An alternate preferred blade for an ice skate includes an edge extending between an anterior end, a central portion including the middle, and a posterior end. The width at the edge gradually increases from the central portion including the middle to the anterior end, but the width at the edge remains constant in and between the central portion including the middle and the posterior end. The width at the edge at the anterior end is preferably in the range between 125–150% of the width at the edge at the middle, and also at the posterior end. The width at the edge can gradually increase from the central portion including the middle to the anterior end in a non-linear manner.

An alternate preferred blade for an ice skate includes an edge extending between an anterior end, a middle, and a posterior end. The width at the edge gradually increases from the middle to the anterior end, and to the posterior end. The width at the edge at the anterior end and posterior end is in the range between 125–150% of the width at the edge at the middle. The width at the edge can gradually increase from the middle to the anterior end, and to the posterior end in a non-linear manner to form a curved configuration. Alternately, the width at the edge can gradually increase from the middle to the anterior end and to the posterior end in a linear manner to form a semi-curved configuration.

A preferred blade can be substantially made of a metal material such as steel, stainless steel, or titanium. An alternate preferred blade can be made of a metal material, a thermoplastic material such as ultra high molecular weight polyethylene, an elastomeric material such as polyurethane, a fiber composite material, or a ceramic material, whether in partial or complete combination. Accordingly, an alternate preferred blade can include fiber filler materials such as glass fiber, aramide fiber, carbon fiber, boron fibers, metal fibers, and the like. Further, extremely hard metal filler materials such as titanium carbide, or tungsten carbide, and the like, can be used. In addition, a material having a wettability index equal to or greater than 90 degrees can be included, such as an ultra high molecular weight polyethylene, fluoropolymer materials, silicone materials, and the like.

An alternate blade for an ice skate can include metal and thermoplastic portions. For example, an alternate blade for an ice skate can substantially consist of metal, and can include a longitudinal recess on the bottom side filled with a substantially thermoplastic material, that is, while retaining metal portions on either side of the recess. The thermoplastic material can include a hard metallic filler such as titanium carbide. The thermoplastic material can also include a fiber filler such as glass fiber, aramide fiber, carbon fiber, boron fiber, or a metal fiber such as stainless steel fiber. The thermoplastic material can also include a material having a wettability index equal to or greater than 90 degrees.

An alternate blade for an ice skate can have an elongated figure eight configuration including a central portion including the middle having a straight edge having constant width at the edge, and a notches straddling the central portion forming discontinuities between the central portion, the anterior portion, and the posterior portion of the blade, and also the ice surface.

An alternate blade for an ice skate can include a plurality of segments. In particular, an alternate blade can include a middle segment, anterior segment, and posterior segment. The configuration and composition of these segments can be selectively changed by a skater in order to optimize skating performance.

An alternate blade for an ice skate can be affixed in functional relation to a blade retainer by hinge means. Anterior of the hinge means, a void space in the blade retainer above the top of the blade can facilitate upward movement of the blade with respect to the blade retainer. However, the side clearance tolerances of the blade with respect to the blade retainer can be tight so as prevent substantial side movement of the blade due to torsion or shear forces.

An alternate blade for an ice skate can be reversible and include edges suitable for use on both the top and bottom surfaces of the blade which are essentially the same and interchangeable. Alternately, the top and bottom surfaces and edges of a preferred blade can have different configurations or different material compositions for use in optimizing performance given different skating venues or ice conditions.

A preferred blade can be selectively affixed by mechanical means to a blade retainer consisting of one or more parts. Alternately, a blade can be integrally formed with a blade retainer for affixing to a skate upper.

The present invention can permit and facilitate novel skate designs, configurations, and geometry relative to conventional hockey and speed skates. In some cases, it is possible for a skate upper to be positioned closer to the ice surface without substantially degrading the turning capability of a given skate. This can potentially result in weight reduction, and enhanced performance.

BRIEF DESCRIPTION OF THE DRAWING FIGURES

DETAILED DESCRIPTION OF THE PREFERRED EMBODIMENTS

Figure 1:
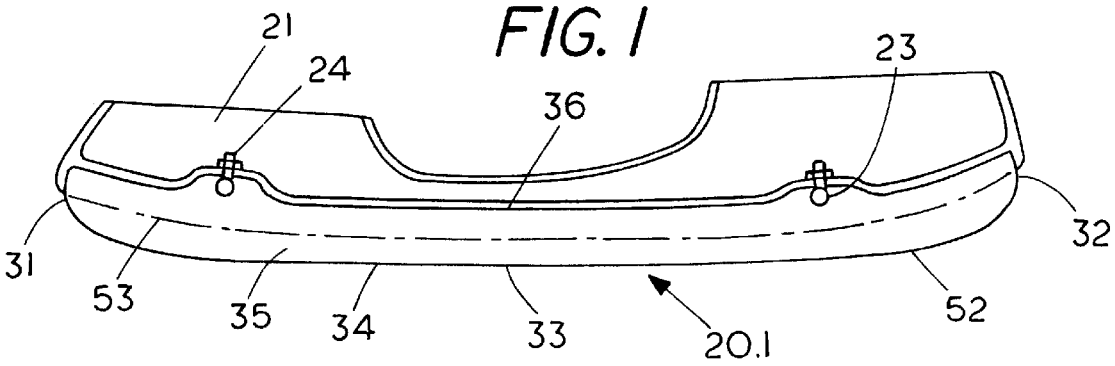
FIG. 1 shows a side view of a removable blade for an ice skate affixed in functional relation to a blade retainer, with parts broken away.
Figure 2:
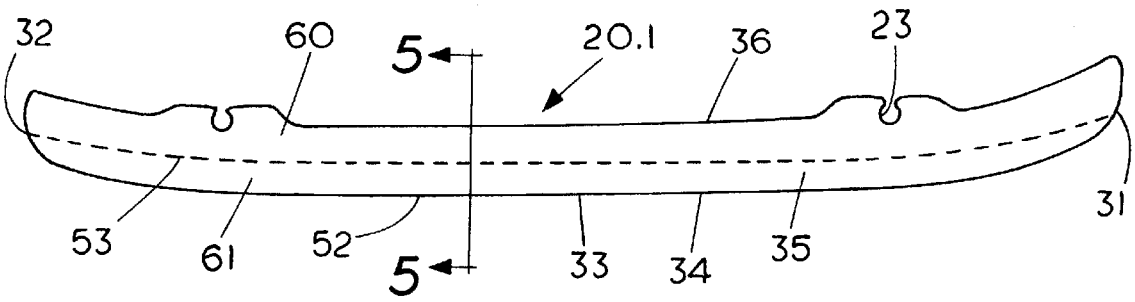
FIG. 2 shows a side view of a removable blade for an ice skate.
Figure 3:
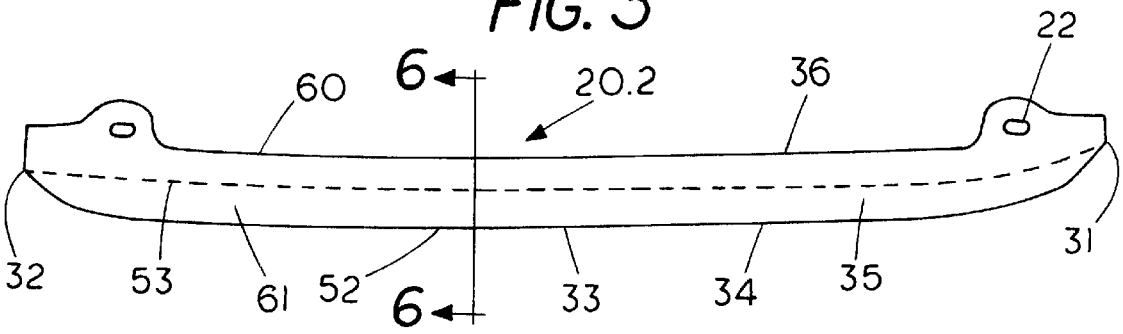
FIG. 3 shows a side view of an alternate removable blade for an ice skate.

General reference to a preferred skate blade will be indicated herein by numeral 20, whereas specific reference to a particular preferred embodiment of a skate blade will be indicated by the addition of a decimal point and numerical suffix to numeral 20. Shown in FIG. 1 is a side view of a runner or blade 20.1 for use in a hockey skate configured for selective removable attachment to a blade retainer 21, with parts of the blade retainer 21 broken away. Also shown is the top 36, side 35, bottom 34, and edge 52 of the blade 20.1. As shown in FIGS. 1–3, a dashed line 53 drawn between the anterior end 31 and posterior end 32 along the sides 35 of the blades 20.1–2 indicates the approximate border as between the upper portion 60 and the lower portion 61 of the blades 20.1–2, The upper portion 60 of the blades 20.1–2 can be inserted within a blade retainer 21, whereas the lower portion 61 includes the working surface and edge 52.

The blade retainer 21 can be affixed to a skate upper 26 with the use of rivets, bolts, fasteners, and other conventional means known in the prior art. The blade retainer 21 can be made of a metal material 43 such as stainless steel, a fiber composite material 56 such a glass or carbon fiber composite, or a thermoplastic material 44 such as nylon, and can be formed by injection molding, reaction injection molding, compression molding, or other conventional means known in the prior art.

As taught in U.S. Pat. No. 4,907,813 to Hall, and U.S. Pat. No. 5,484,148 to Olivieri, both of these patents hereby, being incorporated by reference herein, skate blades presently made by Bauer® or Canstar Sports include notches 23 at the anterior end 31 and posterior end 32 of the blade, as shown in FIGS. 1 and 2. Two bolts 24 which include heads are used to mechanically engage the notches 23. When the ice skate blade is inserted in functional relation to the ice skate blade retainer 21, the bolts 24 can be inserted and tightened to secure the blade in position. The bolts 24 then extend substantially vertically and are affixed with a nut and washer in functional relation to a blade retainer 21. As taught in U.S. Pat. No. 5,318,310 to Laberge, this patent hereby being incorporated by reference herein, skate blades made by CCM® or Sports Maska Inc. include openings 22 which extend substantially horizontally and transverse with respect to the longitudinal axis 42 of the blade, as shown in FIG. 3. When the blade is inserted in functional relation to the blade retainer 21, these openings 22 can be aligned with like registered openings 22 in the blade retainer 21, and a bolt 24 comprising male and female threaded parts, can then be used to affix the blade to the blade retainer 21. The aforementioned configurations can be employed in the present invention, as well as others.

A preferred blade 20 can include a novel configuration and/or a material composition. A preferred blade 20 having a novel configuration can be made of metal such as steel, stainless steel, or titanium. A blade made of metal can be formed by die cutting sheet stock of metal material, cutting with the use of electric, gas, plasma, water, or laser cutting equipment, die stamping or forging metal material under heat and pressure, casting, injection molding, or employing other conventional means known in the metal working industry and prior art.

An alternate preferred blade 20 can be made of a thermoplastic material 44 such as nylon or polyurethane. Further, a blade 20 made of thermoplastic material 44 can include a hydrophobic material such as an ultra high molecular weight polyethylene (UHMW PE), a fluoropolymer, or a silicone material. An alternate preferred blade 20 can also be made of a composite material such as a resin or epoxy material including glass, aramide, carbon, boron, or stainless steel fibers, a thermoplastic metal matrix material, or a ceramic material. An alternate preferred blade 20 can include one or more filler materials such as carbon black, graphite, glass fiber, aramide fiber, carbon fiber, boron fiber, stainless steel fiber, microspheres, fluorinated fillers such as fluorinated graphite, silicone, $MoS^2$, diamond, metal fillers such as titanium carbide or tungsten carbide, and the like. Titanium coated graphite is made by Lanxide Coated Products of Newark, Del. A three-laser method of depositing diamond films, or titanium carbide onto metals is used by Q.Q.C., Inc. of Dearborn, Mich. Aluminum based ceramics, and non-oxide ceramics are made by Hoechst CeramTec A. G. of Lauf, Germany. European Patent 311,196 and Dutch Patent 8,702,068, hereby incorporated by reference herein, teach blades made of ceramic or fiber reinforced material.

Skate blades 20 which are substantially made of a thermoplastic material can be formed by injection molding, reaction injection molding, compression molding, extrusion, and other conventional means known in the plastics industry and prior art, Suppliers and compounders of thermoplastic materials suitable for use in the present invention include LNP Engineering Plastics of Exton, Pa., which make products such as Thermocomp® glass fiber reinforced plastics, Lubricomp® carbon fiber reinforced plastics, Verton® long fiber reinforced plastics, Lubriloy® a internally lubricated plastics, and Stat-Kon® electrically active plastics. Thermoplastic materials suitable for use can include, e.g., polyphenylene sulfide, polyurethane, ultra high molecular weight polyethylene (UHMW PE), fluoropolymers, Nylon materials such as Nylon 6, 6/6, 6/10, 12, and 46, polycarbonate, polypropylene, polyetheretherketone (PEEK), and the like. Another supplier and compounder of thermoplastic materials suitable for use in the present invention is DSM Engineering Plastics of Evansville, N.J. Further, it can be readily understood that makers of thermoplastic materials suitable for use as bearings can possess engineering knowledge and materials which are possibly suitable for use in the present invention. The maker of NYLINER® thermoplastic bearing materials is Thompson Industries, Inc. of Port Washington, N.Y. The maker of IGLIDE® and DRYLIN® thermoplastic bearing materials is IGUS Inc. of East Providence, R.I. A supplier of various fluoropolymer materials is Sigma-Aldrich company of Milwaukee, Wis. A maker of self-lubricating GRAPHALLOY® bearings is Graphite Metalizing Corporation of Yonkers, N.Y. It is known that the inclusion of graphite in a self-lubricated bearing can provide advantageous wear properties in a wet environment.

A supplier of preferred thermoplastic materials including hard metallic filler is Composite Particles, Inc. of Allentown, Pa. Composite Particles, Inc. makes a VISTAMER® product line including VISTAMER® Ti-911x that generally consists of UHMW PE including titanium carbide, and VISTAMER® Ti-912x that generally consists of polyimide including titanium carbide. These materials can be compounded with other thermoplastic materials, e.g., VISTAMER® Ti-9113 has been compounded with the following materials by weight: 42.35% polyphenylene sulfide resin, 23.10% glass fibers, 11.55% polytetrafluoroethylene (TEFLON®), and 23% VISTAMER® Ti-9113 which includes UHMW PE and titanium carbide. This compound has been used to make bearings which find use in oil well drilling and are subject to a hostile environment including water, sand, and high repetitive loading. VISTAMER® Ti-9115 is another variant which is suitable for urethane and elastomeric compositions. It is possible to load a thermoplastic material, such as polyurethane including VISTAMER®, with a metal fiber, or a metal filler such as titanium carbide, generally in the range approximately between 0–85 percent by weight, as desired. These materials and their related manufacturing processes can be used in making various embodiments of the present invention.

FIG. 2 shows a blade 20.1 having a side view configuration generally similar to blades presently made by Bauer® or Canstar Sports. FIG. 3 shows a blade 20.2 having a side view configuration similar to blades presently made by CCM® or Sports Maska Inc. Also shown are the top 36, side 35, bottom 34, edge 52, upper portion 60, lower portion 61, anterior end 31, middle 33, and posterior end 32 of the blades 20.1–2.

Figure 4:
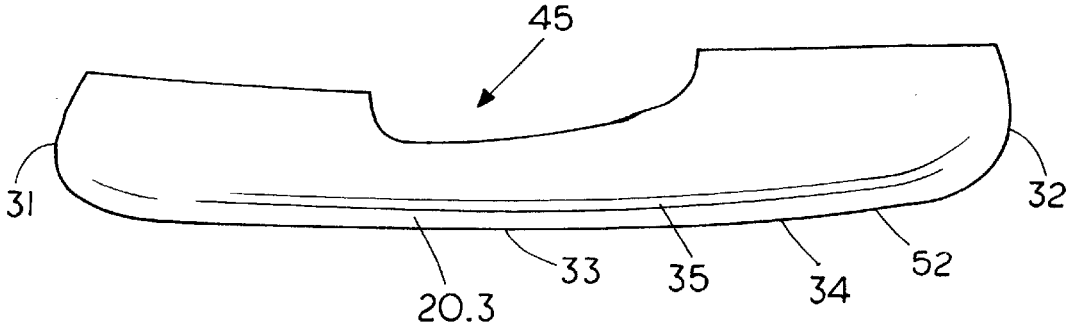
FIG. 4 shows a side view of a blade for an ice skate including an integral blade retainer.

As shown in FIG. 4, an alternate preferred ice skate blade 20.3 can be formed integrally with a retainer 21 which can be affixed in functional relation to a skate upper 26. The alternate blade 20.3 shown in FIG. 4 can be made using thermoplastic materials 44 which can include fiber fillers 28, or composite materials including fiber fillers 28 and resin or epoxy materials. The fiber filler 28 can consist of glass, aramide, carbon fiber, boron fiber, stainless steel fiber, and the like. Relatively hard and long wearing metallic fillers 27 can also be included such as titanium carbide or tungsten carbide, and the like.

Figure 5:
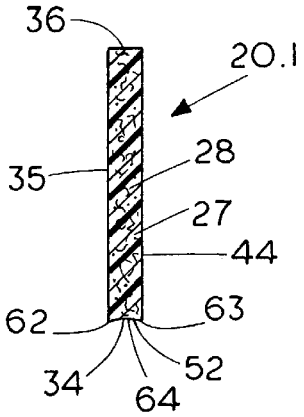
FIG. 5 shows a transverse cross-sectional view of the ice skate blade shown in FIG. 2, taken along line 5—5.

FIG. 5 is a transverse cross-sectional view of a preferred thermoplastic ice skate blade 20.1 shown in FIG. 2, taken along line 5—5. Shown is the presence of thermoplastic material 44, fiber filler 28, and metal filler 27. The fiber filler 28 can consist of glass, aramide, carbon fiber, boron fiber, or stainless steel fiber, and the like. The metallic filler 27 can consist of titanium or tungsten carbide, or other relatively hard and long wearing metal materials. The fiber filler 28 and metallic filler 27 materials are shown to be relatively evenly dispersed in the blade 20.1 shown in FIG. 5. Again, the blade 20.1 shown in FIG. 5 can be made by injection molding, or other conventional means known in the manufacturing art.

Figure 6:
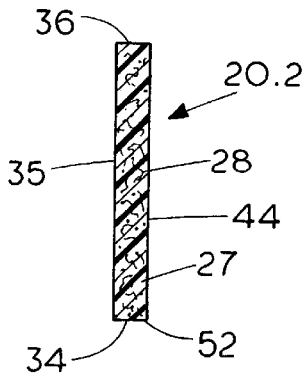
FIG. 6 show a transverse cross-sectional view of the ice skate blade shown in FIG. 3, taken along line 6—6.

FIG. 6 is a transverse cross-sectional view of an alternate preferred thermoplastic ice skate blade 20.2 shown in FIG. 3, taken along line 6—6. Shown is the presence of thermoplastic material 44, fiber filler 28, and metal filler 27. The fiber filler 28 can consist of glass, araride, carbon fiber, boron fiber, or stainless steel fiber, and the like. The metal filler 27 can consist of titanium or tungsten carbide, or other relatively hard and long wearing metallic fillers. In contrast with FIG. 5, the fiber filler 28 and metal filler 27 materials are shown to be unevenly dispersed in the blade 20.2 shown in FIG. 6. This can be accomplished by first permitting the metal filler within the injected thermoplastic material 44 to settle with the use of gravity or a magnetic field, or alternately, by employing a dual injection molding techniques during manufacture. Again, a preferred ice skate blade 20 can also be made by other conventional means known in the manufacturing art, such as reaction injection molding. The heterogeneous composition of the blade 20.2 shown in FIG. 6 can facilitate the manufacture of a robust blade 20.2 having desired resilience and flexural modulus, but also a hard and long wearing edge 52.

Figure 7:
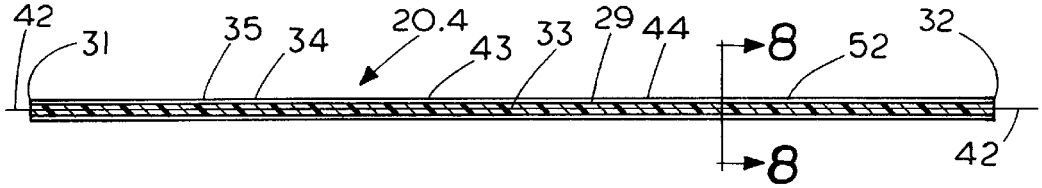
FIG. 7 shows a bottom view of an alternate metal ice skate blade having a recess including a thermoplastic material.

FIG. 7 is a bottom view of an alternate preferred ice skate blade 20.4 including a recess 29 which is filled with a substantially thermoplastic material 44. The recess 29 can extend substantially the full length of the blade 20.4. The recess 29 can be approximately in the range between 5–10 mm in depth, and it can be advantageous that the width of the recess 29 be limited such that at least 0.5 mm of metal material 43 be present along both sides 35. The metal material 43 can provide a hard and long wearing edge 52, whereas the thermoplastic material 44 can reduce weight and serve to decrease the exhibited static or dynamic friction characteristics of the blade 20.4. It is important to be aware that the thermal conductivity and relative rate of expansion and contraction of neat polymers such as polytetrafluoroethylene and polyethylene can be at variance with that of metal and this can raise certain engineering issues when the two materials are used together. However, a blade 20.4 including a recess 29 containing a hydrophobic material having lesser thermal conductivity than a metal material such as steel or stainless steel can potentially provide improved performance under certain conditions. In this regard, see the teachings contained in U.S. Pat. No. 4,314,708 granted to Zuuring, and European Patent 311,196 to Nierstrasz, both of these patents hereby being incorporated by reference herein.

Figure 8:
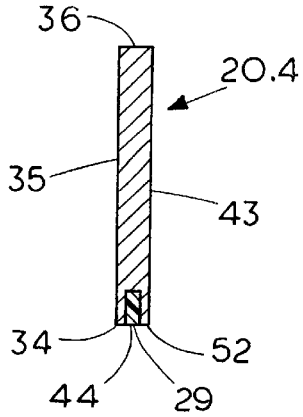
FIG. 8 is a transverse cross-sectional view of the alternate metal ice skate blade having a recess including a thermoplastic material shown in FIG. 7, taken along line 8—8.

FIG. 8 is a transverse cross-sectional view of the ice skate blade 20.4 shown in FIG. 7, taken along line 8—8. The blade 20.4 includes a recess 29 which is filled with a substantially thermoplastic material 44 that is hydrophobic. The recess 29 can extend substantially the full length of the blade 20.4. The recess 29 can be approximately in the range between 5–10 mm in depth, and it can be advantageous that the width of the recess 29 be limited such that at least approximately 0.5 mm of metal material 43 be present along both sides 35. The metal material 43 can provide a hard and long wearing edge 52, whereas the thermoplastic material 44 can reduce weight and serve to decrease the exhibited static or dynamic friction characteristics of the blade 20.4.

Figure 9:
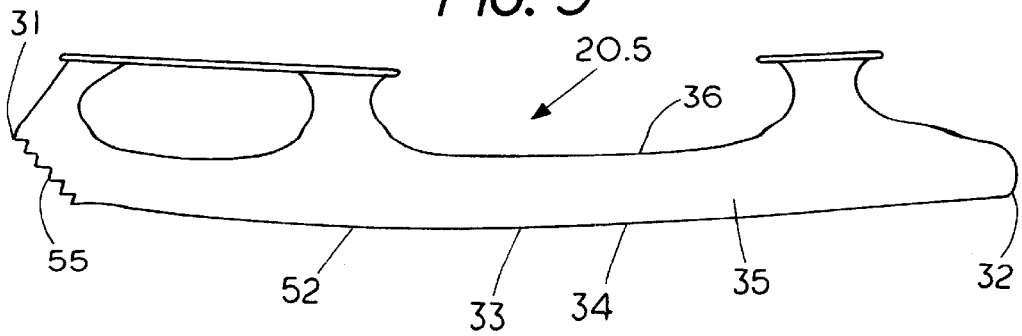
FIG. 9 shows a side view of an alternate blade for a figure skate.

FIG. 9 shows a side view of an alternate blade 20.5 for a figure skate having a toe pick 55 at the anterior end 31 and a configuration generally similar to "Coronation Ace" figure skate blades made by John Wilson Skates, Sheffield, England, that is, when the blade 20.5 is seen in a side view. A conventional figure skate blade can have a width at the edge 52 of approximately 0.1515 inches or 3.85 mm. However, the blade 20.5 shown in FIGS. 9 and 10 varies in width at the edge 52 as between the anterior end 31, middle 33, and posterior end 32.

Figure 10:
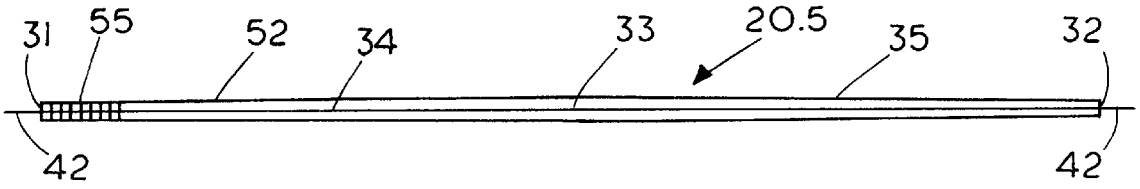
FIG. 10 shows a bottom view of the alternate blade for a figure skate shown in FIG. 9 having greater width at the edge at the middle than at the anterior end and posterior end.

FIG. 10 shows a bottom view of the alternate blade 20.5 for a figure skate shown in FIG. 9, having a toe pick 55 at the anterior end 31. As shown, the blade 20 has greater relative width at the edge 52 at the anterior end 31 than at the posterior end 32, but both the anterior end 31 and posterior end 32 have less width at the edge 52 than the middle 33. As shown in FIG. 10, the approximate length of the blade is 285 mm, and the width of the blade 20.5 at the edge 52 at the anterior end 31 is 3.85 mm, at the middle 33 approximately 5.5 mm, and at the posterior end 32 approximately 3.0 mm. Further, the width of the blade 20.5 at the edge 52 can be asymmetrical, that is, the portion of the blade 20.5 anterior of the middle 33 can have greater average width at the edge 52 than the portion of the blade 20.5 posterior of the middle 33. See also the teachings contained in Canadian Patent 682,629 to Norgiel, this patent hereby being incorporated by reference herein.

Figure 11:
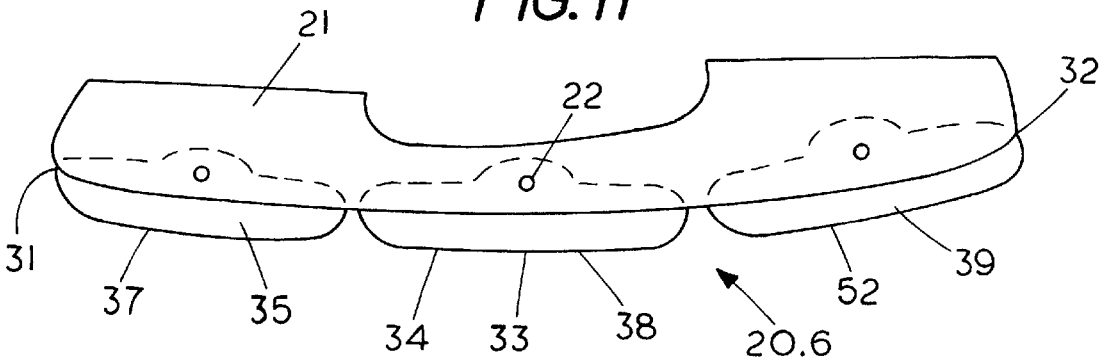
FIG. 11 shows a side view of an alternate ice skate blade having a middle segment, an anterior segment, and posterior segment.

FIG. 11 shows a side view of an alternate blade 20.6 having a plurality of segments. As shown, the alternate blade 20.6 includes a middle segment 38, an anterior segment 37, and a posterior segment 39. The use of an ice skate blade 20.6 consisting of several segments can facilitate a skater changing both the configuration and composition of different portions of the blade 20.6 in order to optimize performance given different skating arenas, ovals, or ice conditions. For example, the amount of rocker, the width of the blade 20.6 at the edge 52, and the type of edge 52 can be changed. Further, the composition of the blade 20.6 can be changed in order to enhance the durability, holding power, speed, and overall performance provided by the blade 20.6. In addition, the composition of the ice skate blade 20.6 used in some or all of the segments can be changed. For example, the material composition of the blade 20.6 selected for use in the middle segment 38 can differ from that selected for use in the anterior segment 37 and posterior segment 39.

Figure 12:
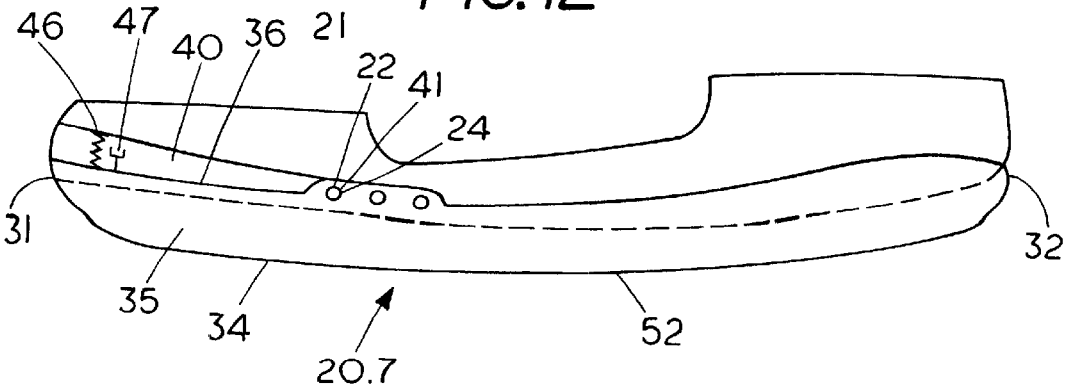
FIG. 12 shows a side view of an alternate skate blade that is affixed to a blade retainer by hinge means, with parts broken away.

FIG. 12 shows a side view of an alternate ice skate blade 20.7 which is affixed by hinge means 41 to a blade retainer 21 that can in turn be affixed to a skate upper 26. This configuration somewhat resembles that of so-called clap skates which are presently being widely used in speed skating. In this embodiment, the void 40 that is provided in the blade retainer 21 above the top 36 of the blade 20.7 anterior of hinge means 41 permits upward movement of the anterior end 31 of the blade 20.7. However, the side clearance tolerances as between the blade 20.7 and blade retainer 21 are tight such that the blade 20.7 cannot substantially be turned sideways by torsion or shear forces. The inclusion of hinge means 41 can facilitate more rapid transition during the skating cycle and thereby enhance skating speed and agility. As shown in FIG. 12, three openings 22 are provided in blade 20.7 The openings 22 permit the blade 20.7 to be affixed in function relation with hinge means 41 to blade retainer 21 at one of three fulcrum points, thus permitting the skater to select from various alternate configurations having different stiffness and dampening characteristics. Also shown in FIG. 12 with the use of symbols well-known in the field of physics and engineering is the possible use of spring means 46 and dampening means 47 with ice skate blade 20.7.

Figure 13:
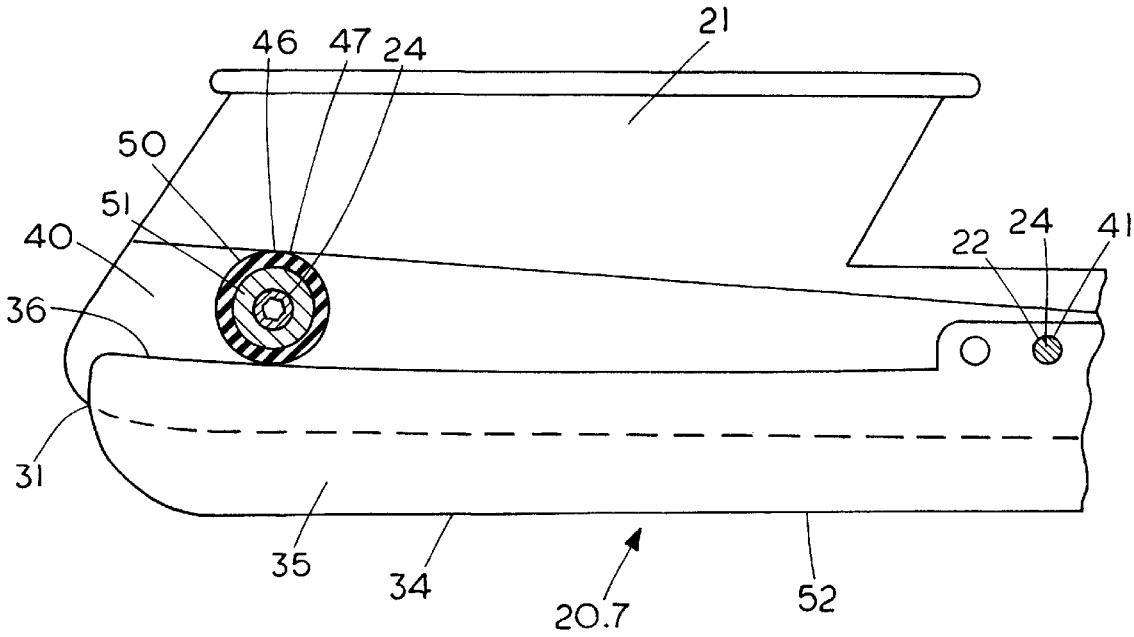
FIG. 13 shows a side view of an alternate skate blade that is affixed to a blade retainer by hinge means, with parts broken away.

FIG. 13 shows a side view of an alternate skate blade 20.7 that is affixed to a blade retainer 21 by hinge means 41,.with parts broken away. Shown is a bolt 24 which passes through an opening 22 for retaining the blade 20.7 in functional relation to hinge means 41 and skate blade retainer 21. Also shown is an elastomeric material 50 positioned within the void 40 between the top 36 of the blade 20.7 and the skate blade retainer 21. The elastomeric material can be made of a resilient natural or synthetic rubber such as nitrile rubber, a thermoplastic material such as polyurethane, or a thermoplastic rubber such as SANTOPRENE®, made by Advanced Elastomer Systems, of Akron, Ohio. The elastomeric material 50 can both serve as spring means 46 and dampening means 47. A skater can then select from various elastomeric material 50 components having different physical and mechanical properties such as hardness, stiffness, and dampening characteristics in order to selectively tune the physical and mechanical response of their skates, as desired. In addition, by tightening or loosening the bolt 24 which bears upon washer 51, the compressive force imparted to the elastomeric material 50 can be selectively adjusted, thus further tuning the physical and mechanical response of the skates, as desired. It can be readily understood that other configurations, devices, and methods can be used to introduce adjustable spring means 46 and dampening means 47 in association with the skate blade 20.7 and blade retainer 21 including hinge means 41.

Figure 14:
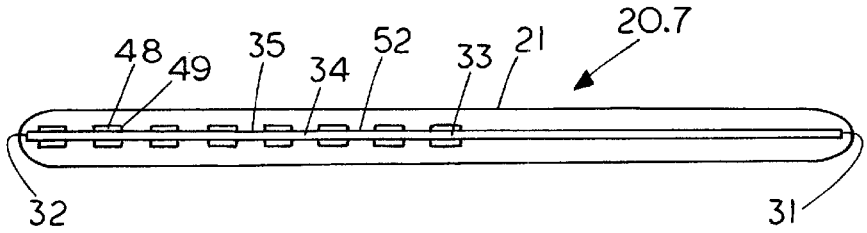
FIG. 14 shows a bottom view of an alternate skate blade that is affixed to a blade retainer by hinge means and having complimentary male and female mechanical engagement means.

FIG. 14 shows a bottom view of an alternate ice skate blade 20.7 that is affixed to a blade retainer 21 by hinge means 41 showing complimentary male mechanical engagement means 48 and female mechanical engagement means 49. As shown in FIG. 14, relatively tight side clearance tolerances exist between the ice skate blade 20.7 and the blade retainer 21. The presence of complimentary male mechanical engagement means 48 and female mechanical engagement means 49 can serve to further enhance the robustness of the combined skate blade 20.7 and blade retainer 21. In particular, this configuration can enhance the resistance of the combination to torsion and shear forces.

Figure 15:
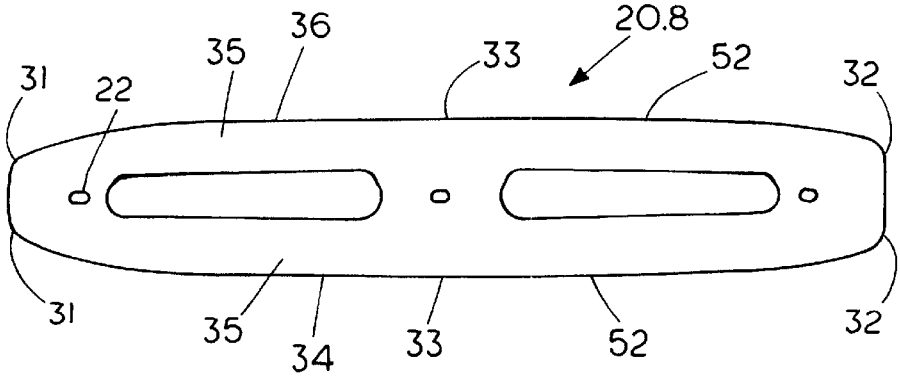
FIG. 15 shows a side view of an alternate skate blade including functional top and bottom surfaces including edges.

As shown in FIG. 15, an alternate preferred blade 20.8 can be so configured as to have top 36 and bottom 34 surfaces which can both be selectively and interchangeably used as the working surface and edge 52 of the blade 20.8. The top 36 and bottom 34 working surfaces and edges 52 can be identical and interchangeable. Accordingly, when the bottom 34 surface and edge 52 of the blade 20.8 become dull, a skater can simply remove several bolts 24, or otherwise suitably manipulate other mechanical engagement means, and essentially flip the skate blade 20.8, thus renew the working surface and edge 52 of the skate blade 20.8. Alternately, the top 36 and bottom 34 surfaces and edges 52 of a preferred blade 20.8 can have different configurations and/or consist of different material compositions. Different rocker and edge characteristics and different material compositions can be advantageous for use in order to optimize skating performance on different skating rinks and ice conditions.

In the present application, use of the term anterior end 31 indicates the anteriormost end of the working surface of an ice skate blade 20. Likewise, the term posterior end 32 indicates the posteriormost end of the working surface of an ice skate blade 20. The term working surface indicates that portion of an ice skate blade 20 which is normally intended and used to make contact and impart force applications to the ice support surface. Sometimes the anterior end 31 of the working surface of a blade 20 will also constitute the anteriormost portion of the blade, and likewise, the posterior end 31 of the working surface of a blade 20 will also constitute the posteriormost portion of the blade. However, it can be readily understood that the aforementioned coincidental relationship is not necessary, rather many other different configurations and permutations are possible. For example, it is sometimes the case that the anteriormost portion of a hockey skate blade is somewhat anterior with respect to the anterior end 31 of the working surface of the blade which bears an edge 52, and likewise, the posteriormost portion can be somewhat posterior of the posterior end 32 of the working surface of the blade which bears an edge 52. In contrast with a hockey skate blade, a figure skate blade has an entirely different design, configuration, and geometry, and includes a toe pick 55 as part of the working surface of the blade. In a figure skate, it can be readily understood that the anterior end 31 of the working surface of the blade is located at the anteriormost portion of the toe pick 55.

Figure 16:
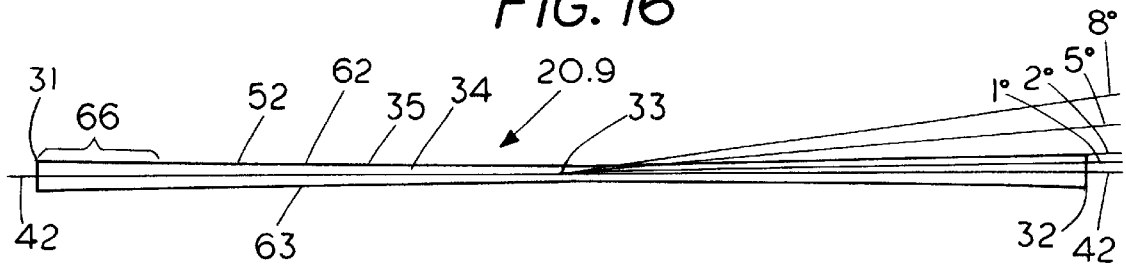
FIG. 16 shows a bottom view of an alternate ice skate blade having greater width at the edge at both the anterior end and posterior end than at the middle.

It can be readily understood that the edge 52 of a blade 20 actually includes an inside edge 62, an outside edge 63, and the bottom 34 portion of the blade 20 which is present therebetween, as shown in FIGS. 5 and 16. Many different skate blade edge configurations are known in the prior art and can be used in the present invention. As shown in FIG. 5, the configuration of an skate blade edge 52 can include a concavity 64 in the bottom side of blade in the area between the opposing inside edge 62 and outside edge 63 which is formed when the blade is sharpened with the use of a grinding wheel having a desired configuration and radius. In the present application, reference to the width of a blade at the edge shall mean an outside width measurement taken between the opposing sides of a blade at their point of intersection with the bottom side of the blade, thus between the directly opposing inside edge 62 and outside edge 63 at any given point along the longitudinal axis 42 such as the anterior end 31, middle 33, or posterior end 32 of the blade.

FIG. 16 shows a bottom view of an alternate preferred ice skate blade 20.9 having greater width at the edge 52 at both the anterior end 31 and posterior end 32 than at the middle 33. As shown in FIG. 16, the width at the edge 52 of the blade 20.9 gradually increases in a linear manner from the middle 33 towards both the anterior end 31 and posterior end 32. The position relative to the longitudinal axis 42 at which the width of the blade 20 at the edge 52 begins to increase can be varied from the middle 33 to a more anterior or posterior position. Alternately, the width of a blade 20 at the edge 52 can be gradually increased in a non-linear or geometric manner from the middle 33 towards both the anterior end 31 and posterior end 32 to create an arcuate, or curved shape, as shown in FIG. 19. Once again, the position relative to the longitudinal axis 42 at which the width of the blade 20 at the edge 52 begins to increase can be varied from the middle 33 to a more anterior and/or posterior position, as desired. In a side view, the blades 20.9–13 shown in FIGS. 16–20 could appear substantially similar to the configurations shown in FIGS. 2 or 3, or other configurations, as desired.

Given the common side stroke skating technique used in hockey and speed skating, a skate blade configuration having greater relative width at the edge 52 at the anterior end 31 and posterior end 32 than at the middle 33 can potentially enable faster acceleration and de-acceleration, improved turning performance, and a stronger or longer skating stroke characterized by greater edge control and application of power. With regards to the ice skate blade configurations shown in FIGS. 16–22, the practical effect is as though the position and effective angle of attack of a conventional blade had been shifted with respect to the longitudinal axis of the skate upper. For example, when speed skaters are to race in a counter-clockwise direction indoors, it is known to shift the mounting position of conventional blades, that is, substantially straight ice skate blades having uniform width. In this regard, the position of the blades are shifted relative to the skate upper towards the direction of the inside of the track. Further, the angle of attack of the blades are sometimes changed from a position approximately parallel to the longitudinal axis of the skate upper and the blades are pointed inwards, that is, the blades are rotated counter-clockwise. In particular, in the case of the right foot, the blade will be rotated to point inwards towards the medial side, and in the case of the left foot, the blade will be rotated outwards towards the lateral side. Speed skaters are also known to bend conventional skate blades having a substantially uniform width towards the direction of the turn by heating, bending, and repeatedly striking their skate blades with a hammer. Such modification of a conventional speed skate blade can facilitate better skating performance given the presence of tight turns on an indoor track or oval. In this regard, it should also be appreciated that hockey players are almost constantly turning within the confines of an indoor hockey arena.

Conventional hockey skate blades made by CCM® or Sport Maska, Inc. commonly have a width at the edge of approximately 0.112 inches or 2.85 mm, and the total length of their 271 mm blade which corresponds to standard sample size for a male wearer having a size 9 article of footwear is approximately 290 mm. Conventional hockey skate blades made by Bauer® or Canstar Sports commonly have a width at the edge of approximately 0.116 inches or 2.95 mm, and the total length of their 272 mm blade which corresponds to standard sample size for a male wearer having a size 9 article of footwear is approximately 295 mm. In contrast, Coronation Ace figure skate blades made by John Wilson Skates, Sheffield, England, are commonly approximately 0.1515 inches or 3.85 mm in width at the edge.

As shown in FIG. 16, blade 20.9 has a total length of 290 mm, and the width at the edge 52 at the anterior end 31 and posterior end 32 is approximately three times that of the middle 33 of the blade 20.9. The width at the edge 52 in the middle 33 of the blade 20.9 is approximately 2.85 mm, and the width at the edge 52 of the anterior end 31 and posterior end 32 is approximately 8.55 mm. The resulting angular deviation from the longitudinal axis 42 of the blade 20.9 at both the anterior end 31 and posterior end 32, that is, when drawn from a point located at the middle 33 of the blade 20.9 along the bisecting longitudinal axis 42 is approximately 2 degrees. Also illustrated for reference purposes in FIG. 16, are angular deviations of 1, 5 and 8 degrees. Generally, the desired amount of angular deviation in a preferred blade 20 for use in a hockey skate having a conventional design, configuration, and geometry, that is, regarding the amount of elevation of a wearer's foot and skate upper 26 above the support surface or ice, will be approximately equal to or less than 2 degrees, and can even be slightly less than 1 degree.

However, given the various widths of skate blades, and also the provision of different skate blade lengths in order to accommodate skaters having different foot sizes, reference to angular deviation in degrees is probably not the best way to describe and define the scope of the present invention. For example, if a CCM® or Sport Maska 271 mm blade having a width of 2.85 mm at the edge that is used on standard sample sized hockey skates is drawn to scale, the middle of the blade having a total length of about 290 mm is found approximately 145 mm from the anterior end 31 and posterior end 32. When measured from a point at the middle 33 and midpoint of the blade, tripling the width at the edge 52 of the blade at the anterior end 31 produces an angular deviation of approximately equal to or less than 2 degrees. Doubling the width at the edge 52 at the anterior end 31 produces an angular deviation between 1 and 2 degrees. Moreover, increasing the width at the edge 52 at the anterior end 31 by only 125% produces an angular deviation that is slightly less than 1 degree. It can be readily understood that these values with respect to angular deviation will change with respect to the different skate blade lengths associated with different skate and skate blade sizes.

Accordingly, it can instead be advantageous to describe and define the width characteristics and configuration of a preferred blade 20 by expressing the width dimension at the edge 52 proximate the anterior end 31 and posterior end 32 as a percentage function of the minimum width at the edge 52 found at the middle 33, or alternately, a central portion 65 of the blade 20 including the middle 33, as opposed to using the amount of angular deviation as a reference. Various alternate prototype skate blades 20 including anterior ends 31, or alternately, both anterior ends 31 and posterior ends 32 having a width at the edge 52 of approximately 125%, 150%, 175%, 200%, and 300% greater relative to the minimum width at the edge 52 at the middle 33, or alternately, at a central portion 65 of the skate blade 20 including the middle 33, have been made and evaluated.

In a hockey skate 57 having a conventional design, configuration, and geometry, and in particular, conventional elevation of a wearer's foot and skate upper 26 above the support surface or ice 67, the preferred width at the edge 52 of a skate blade 20 at the anterior end 31 and posterior end 32 is in the range between 101–300% of the minimum width at the edge 52 found in the middle 33, or a central portion 65 including the middle 33. Different individual skaters can prefer skate blades 20 having different widths at the edge 52 at the anterior end 31, or alternately, at the anterior end 31 and the posterior end 32, but within the general preferred range between 101–300%, the preferred width at the edge 52 at the anterior end 31 and posterior end 32 is normally approximately in the range between 125–135%. In this regard, a scalar effect can exist. For example, a blade 20 having a width at the edge 52 at the anterior end 31, or alternately, at the anterior end 31 and posterior end 32, consisting of 125% of the minimum width at the edge 52 found in the middle 33, or a central portion 65 of the blade 20 including the middle 33, could be preferred by wearers who require a size 8 hockey skate, whereas wearers who require a larger size skate such as size 10½ could prefer a blade 20 having a width at the edge 52 at the anterior end 31, or alternately, at the anterior end 31 and posterior end 32, consisting of 135% of the minimum width at the edge 52 found in the middle 33, or a central portion 65 of the blade 20 including the middle 33.

In order to make prototypes, a blade made by CCM® or Sport Maska having a normal width at the edge 52 of 2.85 mm can be ground down and polished in a central portion 65 including the middle 33 and there reduced to 2.28 mm in order to create a prototype blade having an anterior end 31 and posterior end 32 having approximately 125% greater relative width at the edge 52 than in the central portion 65 including the middle 33. A similar blade 20 having a normal width at the edge 52 of 2.85 mm can be ground down and polished in a central portion 65 including the middle 33 and there reduced to 1.9 mm in order to create a prototype blade 20 having an anterior end 31 and posterior end 32 having approximately 150% greater relative width at the edge 52 than at the central portion 65 including the middle 33. However, a minimum width at the edge 52 of about 2.0 mm approaches the practical lower limit with respect to blades 20 for use in hockey which are made of steel or stainless steel, due to considerations of durability. Moreover, a maximum width at the edge of about 4.0 mm approaches the practical upper limit with respect to blades 20 for use in hockey which are made of steel or stainless steel, due to considerations of weight.

Figure 19:
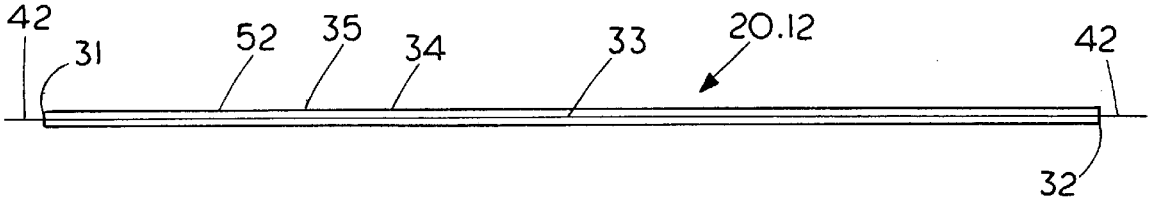
FIG. 19 shows a bottom view of an alternate ice skate blade having a given minimum width at the edge at the middle, and greater width at the edge at the anterior end and posterior end.
Figure 20:
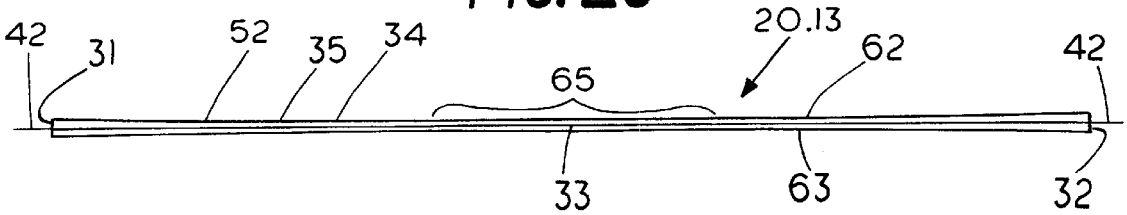
FIG. 20 shows a bottom view of an alternate ice skate blade having greater width at the edge at the anterior end and posterior end than at the middle, and including a central portion including the middle having a constant width at the edge.

It can be readily understood that it is possible to use a blade 20 having a standard width and substantially parallel sides 35 in the upper portion 60 of the blade 20. The upper portion 60 of such a blade 20 for use in a hockey skate could then be inserted and engaged in functional relation to a conventional blade retainer 21, whereas a substantial portion of the upper portion 60 of a blade 20 for use in a speed skate could possibly be exposed. A blade 20 having a standard width and substantially parallel sides 35 in the upper portion 60 of the blade 20 can have narrower width in the lower portion 61 of the blade 20 at the edge 52 at the middle 33, or a central portion 65 including the middle 33, in order to create the desired differential width relationship. Alternately, a blade 20 having a standard width and substantially parallel sides in the upper portion 60 of the blade 20 can have greater width in the lower portion 61 of the blade 20 at the edge 52 near the anterior end 31, or alternately, at the anterior end 31 and posterior end 32, in order to create the desired differential width relationship. Further, various combinations of widening and narrowing different parts of the lower portion 61 of a blade 20 at the edge 52 can be used to create a configuration having the desired differential width relationship. In addition, as shown in FIG. 16, on the superior side of the drawing near the anterior end 31 of the blade 20.9, it can be seen that the width of the blade 20.9 as measured between the side 35 and the longitudinal axis 42 remains relatively constant, that is, there is a constant width portion 66 near the anterior end 31, and the blade 20.9 then gradually tapers in a linear manner towards the middle 33. In contrast, on the inferior side, the blade 20.9 immediately begins to taper gradually in a linear manner towards the middle 33 from the anterior end 31. These subtle deviations serve to illustrate two possible alternate embodiments of a blade 20. It can be readily understood that other designs and configurations are possible in accordance with the teachings and scope of the present invention. For example, the width of the blade 20.9 at the edge 52 could gradually taper in a non-linear or geometric manner from the anterior end 31 and posterior end 32 towards the middle 33 to form an arcuate or curved configuration, as shown in FIG. 19. Moreover, the position along the longitudinal axis 42 at which the edge 52 of the blade 20.9 begins to widen can be at the middle 33, or alternately, can be located anterior and/or posterior of a central portion 65 including the middle 33, as shown in FIG. 20.

Figure 17:
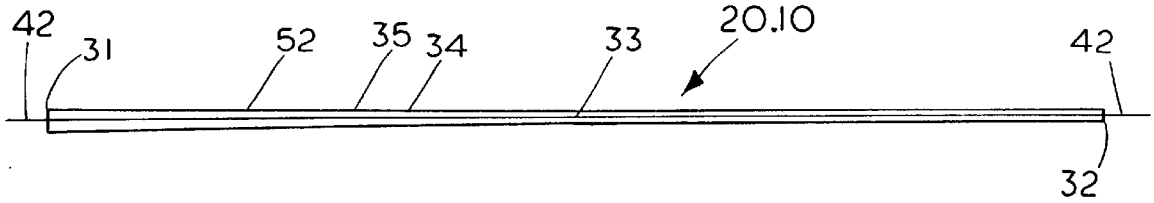
FIG. 17 shows a bottom view of an alternate ice skate blade having a given width at the edge at the middle and posterior end, and greater width at the edge at the anterior end.

FIG. 17 shows a bottom view of an alternate ice skate blade 20.10 having greater width at the edge 52 at the anterior end 31 relative to the middle 33 and posterior end 32. As shown in FIG. 17, the blade 20.10 has a length of approximately 290 mm, a width at the edge 52 in the area between the middle 33 and the posterior end 32 of approximately 2.85 mm, and a width at the edge 52 at the anterior end 31 of approximately 5.7 mm, thus two times or 200% that of the middle 33 and the posterior end 32. Other dimensions and width measurements are possible in keeping with the differential width teachings and scope of the present invention. For example, the width of the edge 52 at the anterior end 31 could be in the range between 125–150% that of the middle 33 and the posterior end 32. Further, the width of the blade 20.10 at the edge 52 can gradually taper in a linear manner towards the middle 33, as shown in FIG. 17. Alternately, the width of the blade 20.10 at the edge 52 could taper gradually in a non-linear manner towards the middle 33 to form an arcuate or curved configuration, as shown in FIG. 19. Moreover, the position along the longitudinal axis 42 at which the edge 52 of the blade 20.10 begins to widen can be at the middle 33, or alternately, can be located anterior and/or posterior of a central portion 65 including the middle 33, as shown in FIG. 20.

Figure 18:
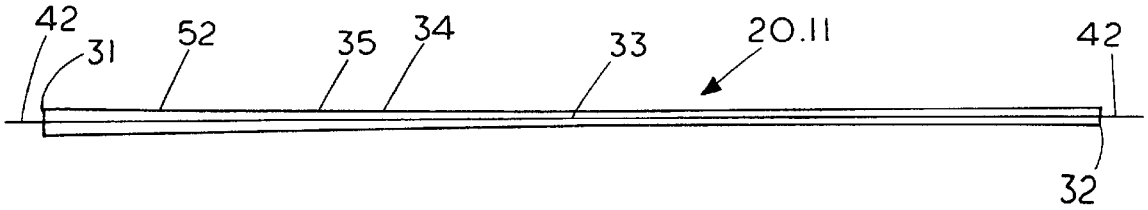
FIG. 18 shows a bottom view of an alternate ice skate blade having a given width at the edge at the middle, and greater width at the edge at the anterior end and posterior end, and the width at the edge at the anterior end is greater than the width at the edge at the posterior end.

FIG. 18 shows a bottom view of an alternate ice skate blade 20.11 having a given width at the edge 52 at the middle 33, and greater width at the edge 52 at the anterior end 31 and posterior end 32, and the width at the edge 52 at the anterior end 31 is greater than the width at the edge 52 at the posterior end 32. As shown in FIG. 18, the blade 20.11 has a length of approximately 290 mm, a width at the edge 52 in the middle 33 of approximately 2.85 mm, a width at the edge 52 at the anterior end 31 of approximately 5.7 mm or 200% that of the middle 33, and a width at the edge 52 at the posterior end 32 of approximately 4.275 mm or 150% that of the middle 33. Again, other dimensions and width measurements are possible in keeping with the differential width teachings and scope of the present invention. For example, the width at the edge 52 at the anterior end 31 could be in the range between 125–150% that of the middle 33, and the width at the edge 52 at the posterior end 32 could be in the range between 110–135% that of the middle 33. Further, the width of the blade 20.11 at the edge 52 can taper gradually in a linear manner towards the middle 33, as shown in FIG. 18. Alternately, the width of the blade 20.11 at the edge 52 could taper gradually in a non-linear manner towards the middle 33 to form an arcuate or curved configuration, as shown in FIG. 19. Moreover, the position along the longitudinal axis 42 at which the edge 52 of the blade 20.11 begins to widen can be at the middle 33, or alternately, can be located anterior and/or posterior of a central portion 65 including the middle 33, as shown in FIG. 20.

FIG. 19 shows a bottom view of an alternate ice skate blade 20.12 having a given minimum width at the edge 52 at the middle 33, and greater width at the edge 52 at the anterior end 31 and posterior end 32. The width of the blade 20.12 at the edge 52 gradually increases in a non-linear or geometric manner from the middle 33 towards the anterior end 31, and from the middle 33 towards the posterior end 32. Accordingly, the sides 35 of the blade 20.12 at the edge 52 form an arcuate or curved configuration. As shown in FIG. 19, the blade 20.12 has a length of approximately 290 mm, the width at the edge 52 in the middle 33 is approximately 2.85 mm, and the width at the edge 52 at the anterior end 31 and posterior end 32 is approximately 3.56 mm or 125% that of the middle 33. Again, other dimensions and width measurements are possible in keeping with the teachings and scope of the present invention. In particular, the preferred width at the edge 52 in the middle 33 can be approximately in the range between 2.18–2.36 mm and the width at the edge 52 at the anterior end 31 and the posterior end 32 can be approximately 2.95 mm, thus the relative width at the edge 52 at the anterior end 31 and posterior end 32 can be approximately in the range between 125–135% that of the middle 33. Moreover, the position along the longitudinal axis 42 at which the edge 52 of the blade 20.12 begins to widen can be at the middle 33, as shown in FIG. 19, or alternately, can be located anterior and/or posterior of a central portion 65 including the middle 33, as shown in FIG. 20.

FIG. 20 shows a bottom view of an alternate ice skate blade 20.13 having a given minimum width at the edge 52 in the middle 33, and greater width at the edge 52 at the anterior end 31 and posterior end 32. The blade 20.13 also includes a substantially straight edge 52 in a central portion 65 including the middle 33, that is, the inside edge 62 and outside edge 63 are parallel to one another and to the longitudinal axis 42 and the width of the blade 20.13 at the edge 52 in the central portion 65 including the middle 33 therefore remains substantially constant. It can be readily understood, that any or all embodiments of a skate blade 20 of the present invention, can include a substantially straight edge 52 in a central portion 65 including the middle 33. A blade 20 having a substantially straight edge 52 in a central portion 65 including the middle 33 is generally preferred for use in hockey skates, as this configuration can provide hockey players with advantageous performance while gliding in a relatively neutral stance.

As shown in FIG. 20, the blade 20.13 has a length of approximately 290 mm, a width at the edge 52 in the middle 33 of approximately 2.85 mm, and a width at the edge 52 at the anterior end 31 and posterior end 32 of approximately 4.27 mm or 150% that of the central portion 65 including the middle 33. Again, other dimensions and width measurements are possible in keeping with the differential width teachings and scope of the present invention. In fact, the embodiment shown in FIG. 20 has been selected primarily for illustrative purposes. In a preferred embodiment, the blade 20.13 has a width at the edge 52 at the anterior end 31 and posterior end 32 in the range between 125–135% that of the width at the edge 52 in the central portion 65 including the middle 33. However, it can be difficult if not impossible to see the aforementioned width differential relationship at the edge 52 of a preferred blade 20.13 with the naked eye, and in particular, when represented in formal patent drawings which are rendered at less than 1/1 scale.

In a preferred embodiment of a blade 20.13 for use in a hockey skate, the preferred minimum width at the edge 52 in the central portion 65 including the middle 33 is equal to or greater than 2.0 mm, and the preferred maximum width at the edge 52 at the anterior end 31 and posterior end 32 is in the range between 2.5–4.0 mm. Further, the preferred maximum width at the edge 52 at the anterior end 31 and posterior end 32 is in the range between 125–135% that of the width at the edge 52 in the central portion 65 including the middle 33. In addition, the width of a preferred blade for use in a hockey skate tapers gradually in a non-linear or geometric manner from the central portion 65 including the middle 33 which has a substantially straight edge 52 having a constant width, to the anterior end 31, and also to the posterior end 32 to form a semi-curved configuration, as shown in FIG. 20. Alternately, the width of a blade for use in a hockey skate can taper gradually in a linear manner from a central portion 65 including the middle 33 which has a substantially straight edge 52 having a constant width, to the anterior end 31, and also to the posterior end 32 to form a semi-curved configuration. The positions along the longitudinal axis 42 at which the edge 52 of a preferred blade 20 for use in a hockey skate begins to widen can be located anterior and/or posterior relative to the blade 20.13 shown in FIG. 20. As shown in FIG. 20, the central portion 65 including the middle 33 having a straight edge 52 of constant width, extends between approximately 40 mm anterior of the middle 33 of the blade 20.13, and 40 mm posterior of the middle 33 of the blade 20.13, as measured along the longitudinal axis 42. In a blade 20.13 for use in the hockey skate having a total length of 290 mm, one-third of the blade's length will be approximately 96.6 mm, and the preferred length of the central portion 65 including the middle 33 having a straight edge 52 of constant width, is normally in the range between 50–140 mm, as measured along the longitudinal axis 42, and in particular, in the range between 80–110 mm. Nevertheless, it can be readily understood that the relative width of a preferred blade 20.13 at the edge 52 at the anterior end 31, posterior end 32, and middle 33, and both the length and relative position of the central portion 65 can be varied, as desired.

Figure 21:
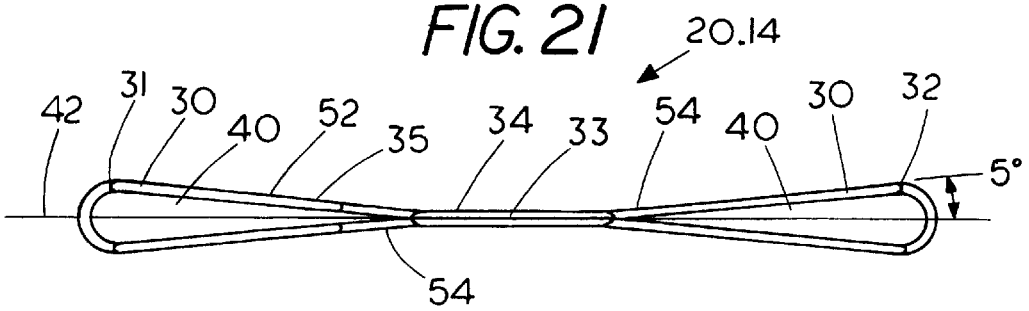
FIG. 21 shows a bottom view of an alternate ice skate blade having an elongated figure eight configuration and ellipses proximate the anterior end and posterior end.
Figure 22:
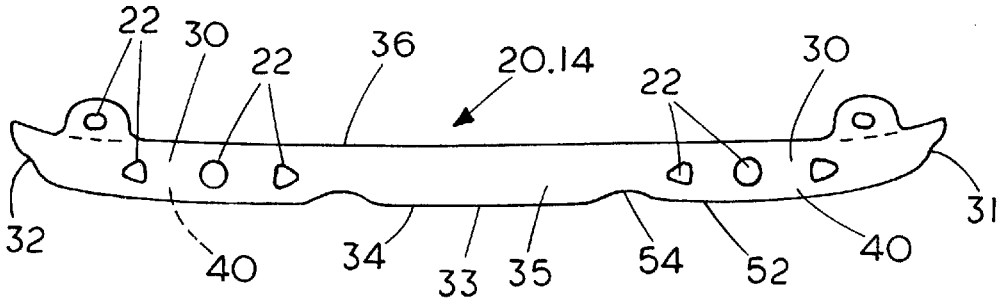
FIG. 22 shows a side view of the alternate ice skate blade shown in FIG. 21, having an elongated figure eight configuration and ellipses proximate the anterior end and posterior end.

FIG. 21 shows a bottom view of an alternate blade 20.14 having an elongated figure eight configuration and ellipses 30 proximate the anterior end 31 and posterior end 32. The presence of a void 40 within the ellipses 30 formed near the anterior end 31 and posterior end 32 of the blade 20.14 can serve to decrease weight and cost. As shown in FIG. 22, the rounded portions near the anterior end 31 and posterior end 32 of the blade 20.14 can be tapered and elevated such that they do not normally bear upon the ice during skating. Various different arcuate or more squared configurations can also be used on the non-working portions of the blade 20.14 near the anterior end 31 and posterior end 32. A blade 20.14 having an elongated figure eight configuration can include a central portion 65 including the middle 33 that is relatively straight and generally consistent with the longitudinal axis 42 having a constant width at the edge 52, and notches 54 straddling the central portion 65 including the middle 33 which form discontinuities between the anterior end 31, central portion 65 including the middle 33, and posterior end 32, and also between the blade 20.14 and the ice surface 67. This can prevent portions of the blade 20.14 from dragging, and can enhance its skating characteristics.

As shown in FIG. 21, the maximum outside width of the ellipse 30 at the anterior end 31 and posterior end 32 is approximately 870% that of the middle 33 of the blade 20.14. The resulting angular deviation from the longitudinal axis 42 of the blade 20.14 at both the anterior end 31 and posterior end 32, that is, when drawn from a point located at the middle 33 of the blade 20.14 on the longitudinal axis 42 is approximately 5 degrees. Again, other dimensions and width measurements are possible in keeping with the differential width teachings and scope of the present invention. For example, the width of the ellipse at the anterior end 31 and posterior end 32 could be 400% that of the central portion 65 including the middle 33. Further, the anterior and posterior portions of the blade 20.14 can taper in a linear manner towards the central portion 65 including the middle 33, as shown, or alternately, could taper in a non-linear or geometric manner to form a more arcuate or curved configuration. Moreover, the size of the central portion 65 including the middle 33, and also that of the ellipses 30 could be varied.

FIG. 22 shows a side view of the alternate ice skate blade 20.14 shown in FIG. 21 including an elongated figure eight configuration and ellipses 30 near the anterior end 31 and posterior end 32. Shown is the possible inclusion of a plurality of openings 22 along the sides 35 of the ellipses 30 near both the anterior end 31 and posterior end 32. These openings 22 can serve to reduce weight, and also can permit the venting of ice and water which could otherwise collect within the central voids 40 of the ellipses 30. Also shown are notches 54 associated with areas of discontinuity as between the edge 52 of the blade 20.14, and the ice surface 67.

Figure 23:
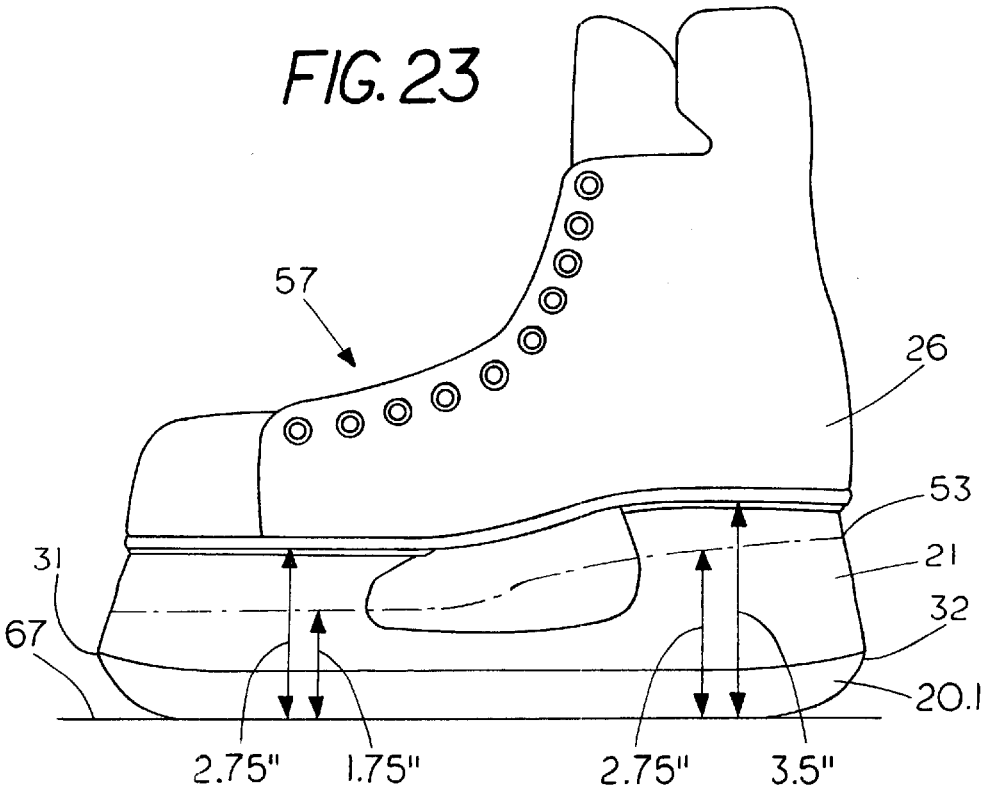
FIG. 23 shows a side view of a conventional hockey skate upper, blade retainer, and blade, and also shows with a dashed line the alternate position of a conventional figure skate upper relative to the support or ice surface.

The present invention can also enable novel functional hockey skate design, configuration, and geometry relative to a conventional hockey skate 57. As shown in FIG. 23, the upper 26 of a conventional size 10½ hockey skate 57 is commonly elevated approximately 85–90 mm or about 3.5 inches in the rearfoot area 58, and approximately 70 mm or about 2.75 inches in the forefoot area 59. In contrast, as indicated by dashed line 53 in FIG. 23, when mounted to a Coronation Ace figure skate blade made by John Wilson Skates, the comparable portions of a figure skate upper 26 are only elevated approximately between 2.5–3.0 inches in the rearfoot area 58, and approximately 45 mm or about 1.75 inches in the forefoot area 59. When using a conventional blade, the turning capability of a hockey or speed skate 57 will greatly depend upon the clearance of the upper 26 with the ice surface 67 when the skate 57 is inclined from the vertical. However, preferred blades 20.9–20.14 of the present invention can generate more turning power given less inclination from the vertical relative to conventional skate blades. Accordingly, the turning capability provided by blades 20.9–20.14 can permit the elevation of a preferred hockey skate upper 26 to be lowered and positioned closer to the ice surface 67 while still providing the turning capability of conventional hockey skates. In a preferred hockey skate 57 of the present invention, the elevation of the upper 26 in the rearfoot area 58 and forefoot area 59 can possibly be reduced approximately in the range between 1–30 mm relative to the conventional hockey skate configuration shown in FIG. 23. Moreover, insofar as the elevation of an upper 26 is reduced, a wearer could possibly prefer and be able to handle, within certain limitations, preferred blades 20.9–14 having greater relative width at the edge 52 at the anterior end 31 and posterior end 32. This can potentially result in weight reduction, and enhanced performance.

While the above detailed description of the invention contains many specificities, these should not be construed as limitations on the scope of the invention, but rather as exemplifications of several preferred embodiments thereof Many other variations are possible. It can be readily understood that the configurations, features, and materials associated with various preferred embodiments can be used in various combinations and permutations. Accordingly, the scope of the invention should be determined not by the embodiments discussed or illustrated, but by the appended claims and their legal equivalents.

I claim:

1. A blade for an ice skate comprising an edge having a working surface for contact and force application to ice, said working surface extending between an anterior end and a posterior end and having a central portion having a length of at least 50 mm including a middle, said edge having a straight bisecting longitudinal axis and having a constant width in said central portion, said edge gradually increasing in width from said central portion to said anterior end, and said edge gradually increasing in width from said central portion to said posterior end.

2. The blade for an ice skate according to claim 1, wherein said edge at said anterior end has a maximum width equal to the width of said edge at said posterior end.

3. The blade for an ice skate according to claim 1, wherein said edge at said anterior end has a maximum width greater than the width of said edge at said posterior end.

4. The blade for an ice skate according to claim 1, wherein the width at said edge gradually increases from said central portion to said anterior end, and also from said central portion to said posterior end in a non-linear manner to form a curved configuration.

5. The blade for an ice skate according to claim 1, wherein the width at said edge gradually increases from said central portion to said anterior end, and also from said central portion to said posterior end in a linear manner to form a semi-curved configuration.

6. The blade for an ice skate according to claim 1, wherein the minimum width at said edge in said central portion including said middle is equal to or greater than 2.0 mm, and the maximum width at said edge at said anterior end and said posterior end is less than or equal to 4.0 mm.

7. The blade for an ice skate according to claim 1, wherein said central portion including said middle comprises a length in the range between 50–140 mm.

8. The blade for an ice skate according to claim 1, wherein the width at said edge at said anterior end is in the range between 101–300% of the width at said edge at said middle, and the width at said edge at said posterior end is in the range between 101–300% of the width at said edge at said middle.

9. The blade for an ice skate according to claim 1, wherein the width at said edge at said anterior end is in the range between 125–135% of the width at said edge at said middle, and the width at said edge at said posterior end is in the range between 125–135% of the width at said edge at said middle.

10. The blade for an ice skate according to claim 1, wherein said blade comprises metal.

11. The blade for an ice skate according to claim 1, wherein said blade comprises thermoplastic material.

12. The blade for an ice skate according to claim 1, wherein said blade comprises a fiber filler.

13. The blade for an ice skate according to claim 1, wherein said blade comprises a carbide metal.

14. The blade for an ice skate according to claim 1, wherein said blade comprises a material having a wettability index equal to or greater than 90 degrees.

15. The blade for an ice skate according to claim 1, wherein said blade comprises mechanical means for affixing said blade to a blade retainer.

16. The blade for an ice skate according to claim 1, wherein said blade is integrally formed with a blade retainer for affixing said blade to a skate upper.

17. A blade for an ice skate comprising an edge having a working surface for contact and force application to ice, said working surface extending between an anterior end, a middle, and a posterior end, the width at said edge gradually increasing from said middle to and including said anterior end, and the width at said edge gradually increasing from said middle to and including said posterior end, said edge at said anterior end comprising greater maximum width than said edge at said middle, and said edge at said anterior end comprising greater maximum width than said edge at said posterior end, wherein the width at said edge at said anterior end is in the range between 125–150% of the width at said edge at said middle, and the width at said edge at said posterior end is in the range between 110–135% of the width at said edge at said middle.

18. The blade for an ice skate according to claim 17, wherein the width at said edge gradually increases from said middle to said anterior end, and also from said middle to said posterior end in a non-linear manner to form a curved configuration.

19. A blade for an ice skate comprising an edge having a working surface for contact and force application to ice, said working surface extending between an anterior end and a posterior end and having a central portion having a length of at least 50 mm including a middle, said edge having a constant width in said central portion, said edge gradually increasing in width from said central portion to said anterior end, and said edge gradually increasing in width from said central portion to said posterior end, said edge at said anterior end having equal maximum width to said edge at said posterior end, the minimum width at said edge in said central portion including said middle being equal to or greater than 2.0 mm, and said maximum width at said edge at said anterior end and said posterior end being less than or equal to 4.0 mm, and the width at said edge at said anterior end and said posterior end being in the range between 110–200% of the width at said edge at said central portion including said middle.

20. A blade for an ice skate, said ice skate including an upper, said blade comprising an edge having a working surface for contact and force application to ice, said working surface extending between an anterior end and a posterior end and having a central portion having a length of at least 50 mm including a middle, said edge having a constant width in said central portion, said edge gradually increasing in width from said central portion to said anterior end, and said edge gradually increasing in width from said central portion to said posterior end, wherein said edge attains maximum width at said anterior end anterior of the anteriormost portion of said upper, and said edge attains maximum width at said posterior end posterior of the posteriormost portion of said upper.

21. A blade for an ice skate, said ice skate including an upper, said blade comprising an edge having a working surface for contact and force application to ice, said working surface extending between an anterior end and a posterior end including a middle, said edge gradually increasing in width from said middle to and including said anterior end, and said edge gradually increasing in width from said middle to and including said posterior end, wherein said edge attains maximum width at said anterior end anterior of the anteriormost portion of said upper, and said edge attains maximum width at said posterior end posterior of the posteriormost portion of said upper.

22. The blade for an ice skate according to claim 21, wherein said edge at said anterior end has a maximum width equal to the width of said edge at said posterior end.

23. The blade for an ice skate according to claim 21, wherein said edge at said anterior end has a maximum width greater than the width of said edge at said posterior end.

24. The blade for an ice skate according to claim 21, wherein the width at said edge gradually increases from said middle to said anterior end, and also from said middle to said posterior end in a non-linear manner to form a curved configuration.

25. The blade for an ice skate according to claim 21, wherein the width at said edge gradually increases from said middle to said anterior end, and also from said middle to said posterior end in a linear manner to form a semi-curved configuration.

26. The blade for an ice skate according to claim 21, wherein the minimum width at said edge at said middle is equal to or greater than 2.0 mm, and the maximum width at said edge at said anterior end and said posterior end is less than or equal to 4.0 mm.

27. The blade for an ice skate according to claim 21, wherein the width at said edge at said anterior end is in the range between 101–300% of the width at said edge at said middle, and the width at said edge at said posterior end is in the range between 101–300% of the width at said edge at said middle.

28. The blade for an ice skate according to claim 21, wherein the width at said edge at said anterior end is in the range between 125–135% of the width at said edge at said middle, and the width at said edge at said posterior end is in the range between 125–135% of the width at said edge at said middle.

29. The blade for an ice skate according to claim 21, wherein said blade comprises metal.

30. The blade for an ice skate according to claim 21, wherein said blade comprises thermoplastic material.

31. The blade for an ice skate according to claim 21, wherein said blade comprises a fiber filler.

32. The blade for an ice skate according to claim 21, wherein said blade comprises a carbide metal.

33. The blade for an ice skate according to claim 21, wherein said blade comprises a material having a wettability index equal to or greater than 90 degrees.

34. The blade for an ice skate according to claim 21, wherein said blade comprises mechanical means for affixing said blade to a blade retainer.

35. The blade for an ice skate according to claim 21, wherein said blade is integrally formed with a blade retainer for affixing said blade to a skate upper.

* * * * *